United States Patent [19]

Machner et al.

[11] 4,304,953

[45] Dec. 8, 1981

[54] METHOD OF PRODUCING A CONSUMABLE ELECTRODE OF LARGE DIAMETER

[75] Inventors: Peter Machner, Leoben; Peter Pressler, Kapfenberg, both of Austria

[73] Assignee: Vereinigte Edelstahlwerke Aktiengesellschaft (VEW), Vienna, Austria

[21] Appl. No.: 41,534

[22] Filed: May 22, 1979

[30] Foreign Application Priority Data

May 24, 1978 [DE] Fed. Rep. of Germany ..... 2822657

[51] Int. Cl.[3] ..... H05B 7/07; H05B 7/101

[52] U.S. Cl. ..... 13/18 R; 13/9 ES

[58] Field of Search ..... 13/18 R–18 C

[56] References Cited

U.S. PATENT DOCUMENTS 4,190,946 3/1980 DeSouza ..... 13/18 R X

*Primary Examiner*—Roy N. Envall, Jr.

*Attorney, Agent, or Firm*—Brumbaugh, Graves, Donohue & Raymond

[57] ABSTRACT

A method of and apparatus for producing consumable electrodes with large diameters to be used for remelting involves assembling the electrode of individual longitudinal parts adjacently arranged. Which longitudinal parts are continuously cast in special moulds as strands having polygonal cross sections. The parts are assembled so as to form a polygonal overall cross section, and their end faces are welded together with a common gripping head for the electrode holding device.

1 Claim, 9 Drawing Figures

METHOD OF PRODUCING A CONSUMABLE ELECTRODE OF LARGE DIAMETER

BACKGROUND OF THE INVENTION

The invention relates to a method of producing consumable electrodes of large diameters for remelting, in particular electroslag remelting, wherein the electrode is assembled of individual longitudinal parts adjacently arranged.

With the ingot treating and remelting processes used to an increasing extent in the high-grade steel industry, consumable electrodes are in most cases used as insert parts. This involves remelting processes, such as vacuum arc-furnace methods and electroslag remelting processes.

Consumable electrodes for the metallurgical methods mentioned above have hitherto been produced by reshaping a cast ingot into an electrode body by rolling or forging and welding a gripping head for an electrode holding device to the same. Although it is possible in this manner to obtain electrode diameters that, as required, are uniform over the total electrode length, reshaping is time consuming. It is furthermore disadvantageous that, when producing rod-shaped bodies from big cast ingots, the ingot segregation inevitably present in the ingot will be recognizeable even in the electrode to be remelted. In some cases, this segregation may be reflected in the remelted ingot—although to a reduced extent.

A further disadvantage of producing consumable electrodes by casting into common closed-end moulds of steel making plants is that these must have a conical shape in order to be able to draw off the mould after the casting has solidified, and the maximum electrode length will depend on the mould length. The mould length, however, cannot be arbitrarily increased. Moreover, a so-called dead-head has to be provided for casting-technological reasons, which dead head has to be separated from the remaining ingot part, thus constituting a loss of material and additional work.

The tendency in the development of the ingot treating and remelting methods is towards the production of ever increasing ingots, having a round cross section as a rule. It is thus necessary to adapt the electrode to the cross section of the mould used for the ingot treating methods. In order to produce consumable electrodes having larger diameters, it has already been proposed to combine rod-shaped bodies made up of several parts having a cross section that corresponds to part or half of a circular cross section (British Pat. No. 1,001,042). These electrodes which, when seen in cross-section, are multiple-part electrodes, thus have an approximately circular outer contour and for this reason can be produced only with difficulty and great expenditure. Another proposal provides for melting together into one ingot, consumable electrodes that are multiply subdivided in the longitudinal and transverse directions, the individual construction elements having a square cross section which is produced by forging; the outer contour of these electrodes is also square (British Pat. No. 1,002,106). This type of assembled electrode not only is complex and time consuming in its production, it also cannot be used for the production of ingots in circular moulds, which shape is needed because the cross section of the consumable electrode has to be designed such that its surface has a nearly uniform distance from the rim of the mould top part (Austrian Pat. No. 282,845) and from the remelting electrode, respectively.

SUMMARY OF THE INVENTION

It is the object of the present invention to overcome the disadvantages of the known methods for producing consumable electrodes, i.e. to provide an improved method with which it is possible to produce in a simple and cheap way, high-quality consumable electrodes which also have large diameters. The electrodes are to have a nearly constant chemical composition over their lengths, are to be largely free from segregations and are to have uniform cross sections. A further object of the invention is the production of consumable electrodes of any length, which have an outer contour that substantially corresponds to the inner contour of the mould top part and the remelting mould, respectively.

These objects of the invention are achieved by applying continuous casting methods to form longitudinal parts as strands with polygonal cross sections, assembling the parts to form a polygonal overall cross section, and welding their front faces together with a common gripping head for the electrode holding device.

The invention furthermore relates to a continuous casting mould for continuously casting the longitudinal parts of the consumable electrodes. This mould comprises mould narrow side parts that are displaceably arranged between two parallel mould parts forming the broad sides of the mould. The mould is characterized in that each mould side part has at least two supporting faces for the strand that are arranged at an angle to each other.

A consumable electrode produced according to the method of the invention is characterized in that the longitudinal parts, in cross section, have the form of irregular polygons whose width is considerably greater than their height, and are assembled to form an at least approximately regular-polygonal cross section for the electrode.

Advantageously, the consumable electrode, in cross section, has the shape of a regular octagon assembled of two octagon-halves adjacently arranged.

The two narrow-side supporting faces of the continuous casting mould used for the production of such a consumable electrode, enclose an angle of 135°. The width of one supporting face on the broad side of the mould corresponds to the side length of the octagon, and the width of the opposite supporting face corresponds to the diameter of the electrode.

In order to produce particularly thick electrodes, for instance with a diameter of more than 900 mm, it is advantageous to assemble several longitudinal parts in an annular manner so as to form an electrode cross section with an approximately regular-polygonal outer contour and to leave free an inner space that is also polygonal.

According to a preferred embodiment, the inner space is filled by a longitudinal part that has also been continuously cast.

BRIEF DESCRIPTION OF THE DRAWING

The invention will be described in more detail by way of embodiments illustrated in the drawings, wherein:

FIG. 8 shows a fully assembled electrode while

DESCRIPTION OF ILLUSTRATIVE EMBODIMENTS

Figure 1:
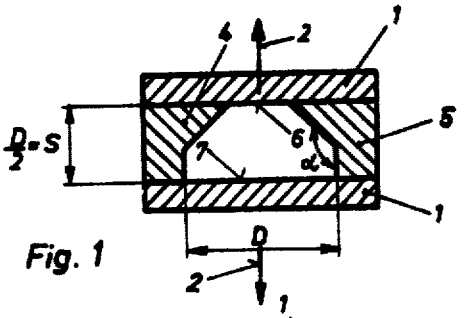
FIG. 1 is a horizontal section through a continuous casting mould shown in schematic illustration, which mould is used for the production of sexagonal strands that are assembled in pairs to form a two-part electrode whose cross section is illustrated in FIG. 2.

In FIG. 1, there is shown broad side mould parts 1 of a rectangular slab mould for the continuous casting of steel. Parts 1 are displaceable in the direction of arrows 2 so as to produce strands of various thicknesses.

Figure 2:
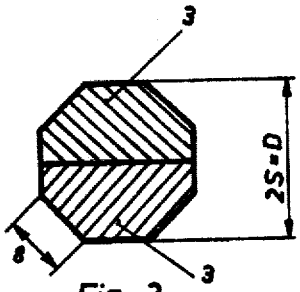

In order to produce an octagonal consumable electrode of two strands 3 by continuous casting, according to FIG. 2, the normally straight mould parts forming the narrow sides are replaced by angular mould side parts 4, 5 having two supporting faces which enclose an angle $\alpha$ of 135°. These mould side parts 4, 5 are arranged relative to each other in a mirror-reflected way. Supporting faces 6, 7 on the two broad-side mould parts 1 are such that the supporting face 6 has a width that corresponds to the side length 8 of the regular octagon, while the width of the opposite supporting face 7 corresponds to the electrode diameter D, wherein $D=2S$, and in practice may be for instance 600 mm. The mould of FIG. 1 is then used in a conventional manner to cast the strands 3 of any convenient length. The longitudinal dimensions of strands 3 are then welded together in the form shown in FIG. 2.

Figure 3:
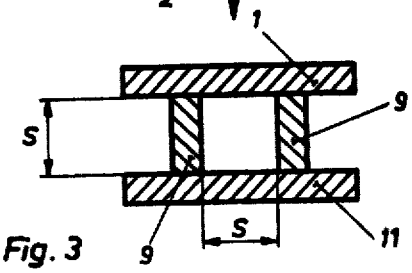
FIGS. 3 and 4 are also horizontal sections through a continuous casting mould, one for the production of a billet, and one for sexagonal cast strands.
Figure 5:
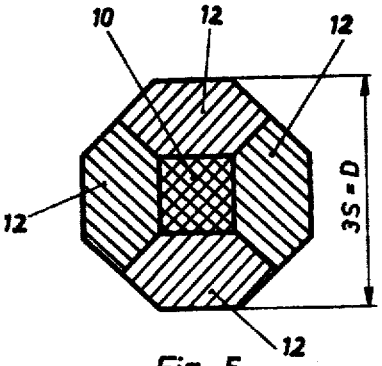
FIG. 5 shows a cross section of a consumable electrode assembled of these strands.
Figure 4:
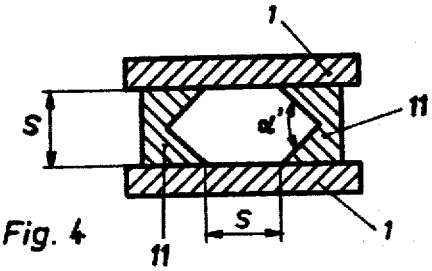

In FIG. 3, a continuous casting mould for slabs has been adjusted for the production of billets 10 having a side length S, through the use of narrow-side, plane mould side parts 9 and broad side parts 1 which are used for slab casting. The mould side parts 9 are then replaced, as is illustrated in FIG. 4, by angular mould side parts 11. Each of these have two supporting faces for the strand that enclose an angle $\alpha'$ of 90°. This results in a sexagonal casting cross section for a strand 12 having a thickness S and a width S for the supporting faces formed by the mould parts 1. Therefore, it is possible to combine one square billet 10 with four sexagonal strands 12 to form an octagonal consumable electrode having a diameter $D=3$ S, for instance of 900 mm, as is illustrated in FIG. 5.

Figure 6:
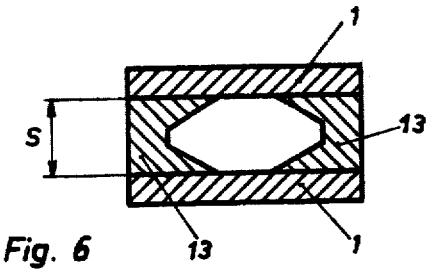
FIG. 6 represents the production of octagonal strands which are assembled to form a three-part electrode according to FIG. 7.
Figure 7:
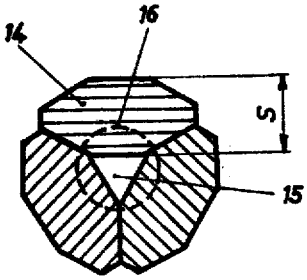
Figure 8:
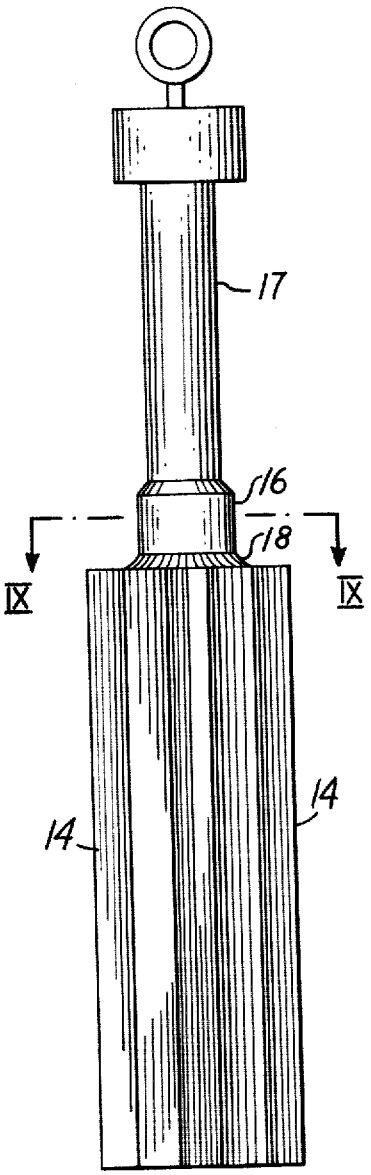
Figure 9:
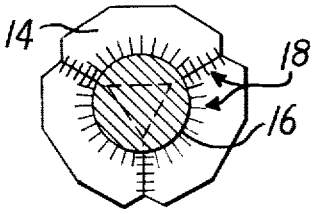
FIG. 9 shows a cross section thereof along line IX—IX.

In FIG. 6, the production of octagonal strands 14 by using angular mould side parts 13 with three supporting faces each, is illustrated. The electrode made up of three of the strands 14 has a polygonal cross section with a small central cavity 15 of triangular cross section, which cavity has no negative effects during operation. The broken-line contour 16 shown in FIGS. 7 and 9 defines the position of a gripping head 17 for the electrode holding device of FIG. 8. This gripping head and the individual electrode parts are combined by welds 18, so that an electrically well-conducting and mechanically sufficient connection is created. Naturally, similar fixed gripping heads are provided for the embodiments illustrated in FIGS. 2 and 5.

The method of the invention can be applied in a particularly advantageous manner for the production of electrodes having a diameter of more than 350 mm. With the continuous casting plants for steel slabs built so far, the possible strand thickness lies in a region between 115 and 320 mm. Therefore, it is possible to produce in those plants continuous steel strands for consumable electrodes which—when assembled of several individual strands—have diameters of for instance 600 to 1,000 mm.

The electrode having a polygonal cross section, compared to a round strand electrode, has the advantages of a simpler and operationally safer production. Round strands with large diameters require plants that are complex in their construction, and are difficult to cast without cracks.

All electrodes produced according to this method can be well utilized for the initially-mentioned melting processes, in particular for the electroslag remelting process using round moulds, after the electrode parts have been sand-blasted or cleaned in another way for removing the cinder skin prior to assembling. The chemical composition and the diameter are uniform over the length of these consumable electrode.

What we claim is:

1. In a method of producing a consumable electrode of large diameter, having a substantially uniform chemical composition over its entire length and total cross section, to be used for remelting, for example electroslag remelting, said consumable electrode being assembled of at least two adjacently arranged individual longitudinal parts, the improvement which comprises the steps of:

continuously casting said at least two longitudinal parts in a manner so as to form strands having polygonal cross sections, assembling said at least two individual longitudinal parts so as to form a polygonal overall cross section, providing a common gripping head for an electrode holding means, and welding together the end faces of said at least two individual longitudinal parts with said common gripping head.

* * * * *